US006994402B1

(12) United States Patent
Dodge

(10) Patent No.: US 6,994,402 B1
(45) Date of Patent: Feb. 7, 2006

(54) FURNITURE FRAME BRACKET

(76) Inventor: Peter W. Dodge, 2913 Twenty-five and One Half Ave., Birchwood, WI (US) 54817

( * ) Notice: Subject to any disclaimer, the term of this patent is extended or adjusted under 35 U.S.C. 154(b) by 0 days.

(21) Appl. No.: 10/852,072

(22) Filed: May 24, 2004

(51) Int. Cl.
*A47C 7/16* (2006.01)

(52) U.S. Cl. ..... 297/452.18; 297/440.15

(58) Field of Classification Search ..... 297/463.1, 297/452.18, 449.1, 445.1, 440.15; 248/220.1, 248/201.5, 205.1; 403/335, 337, 24
See application file for complete search history.

(56) References Cited

U.S. PATENT DOCUMENTS

| | | | | | |
|---|---|---|---|---|---|
| 942,570 | A | * | 12/1909 | Lawrence | 297/449.1 |
| 1,380,518 | A | * | 6/1921 | Bellig | 403/219 |
| 2,721,606 | A | * | 10/1955 | Fitch | 403/384 |
| 4,949,929 | A | * | 8/1990 | Kesselman et al. | 248/300 |
| 5,795,028 | A | * | 8/1998 | Dussia et al. | 297/440.14 |
| 5,897,086 | A | * | 4/1999 | Condon | 248/220.1 |
| 6,568,642 | B1 | * | 5/2003 | Kirschner | 248/65 |

* cited by examiner

*Primary Examiner*—Milton Nelson, Jr.
(74) *Attorney, Agent, or Firm*—Jacobson & Johnson

(57) ABSTRACT

A furniture frame and a furniture frame bracket wherein the furniture frame bracket comprises a bracket main body having a surface for engaging a portion of a furniture frame and a leg for supporting a linkage between a first section and a second section of a furniture frame.

10 Claims, 5 Drawing Sheets

FURNITURE FRAME BRACKET

FIELD OF THE INVENTION

This invention relates to furniture frames, and more specifically to a furniture frame having a bracket mechanism for supporting a linkage between a first section and a second section of the furniture frame such as a backrest section and a seat section of the furniture frame.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Furniture frames that are convertible between a bed position and a couch position are known in the art. Use of convertible furniture frames allow users to maximize the use of a limited living space such as that of a studio or a small apartment by reducing the space dedicated for the furniture. That is, instead of requiring a space in the apartment dedicated solely for the user's bed and another space in the apartment dedicated solely for the user's couch or sofa, the use of the convertible furniture frame allow the user to eliminate one of the aforementioned dedicated furniture spaces thereby providing the user with increased living space.

The assembly of the aforementioned prior art convertible furniture frames normally includes at least one but usually two linkages between a first section of the furniture frame and a second section of the furniture frame such as a backrest section and a seat section. The linkage between the backrest section and the seat section normally occurs at the sides of the backrest section and the seat section of the furniture frame and is traditionally connected by just a pin or bolt extending through the sides of the backrest section and the seat section. More specifically, in linking the sides of the backrest section to the seat section, the pin or bolt normally extends through the sides of the backrest section first and then through the seat section by way of an elongated slot located thereon, the elongated slot allowing for the horizontal displacement of the seat section for the conversion of the furniture frame between and the bed position and the couch position. A securing member such as a bolt is then attached to a free end of the pin or bolt to maintain the aforementioned linkage.

Although prior art convertible furniture frames work for their intended purpose, due to the fact that the linkages between the backrest section and the seat section of the furniture frame are mainly supported by the side members of the backrest section and the seat section, prolong and/or substantial use of the prior art convertible furniture frames can often weaken the linkage of the furniture frame to a point where the linkage is broken due to potential cracking of the sidewalls of the furniture frame. The aforementioned problem is especially true around the areas where the elongated slot of the seat section is located.

The present invention solves the above problem by providing for a furniture frame having a furniture frame bracket for further supporting the linkage between the sides of the backrest section and the seat section of the furniture frame so as to distribute the forces that are directed on the linkages between the backrest section and the seat section of the furniture frame so as to reduce the potential for breakage of the aforementioned linkage.

SUMMARY OF THE INVENTION

The present invention is a furniture frame and a furniture frame bracket. The furniture frame includes a backrest section having a first side, a second side, and a cross panel member linking the first side of the backrest section to the second side of the backrest section and a seat section having a first side, a second side, and a cross panel member linking the first side of the seat section to the second side of the seat section. The linkage of the furniture frame of the present invention includes a first pin having a free end and a second pin having a free end with the first pin extending through the first side of the first section and the first side of the second section and the second pin extending through the second side of the first section and the second side of the second section.

The furniture frame of the present invention further includes a furniture frame bracket comprising a bracket main body having a surface for engaging a portion of a furniture frame such as the cross panel member of the backrest section or the cross panel member of the seat second and a leg for further supporting the linkage between the backrest section and seat section.

DESCRIPTION OF THE DRAWINGS

Figure 1:
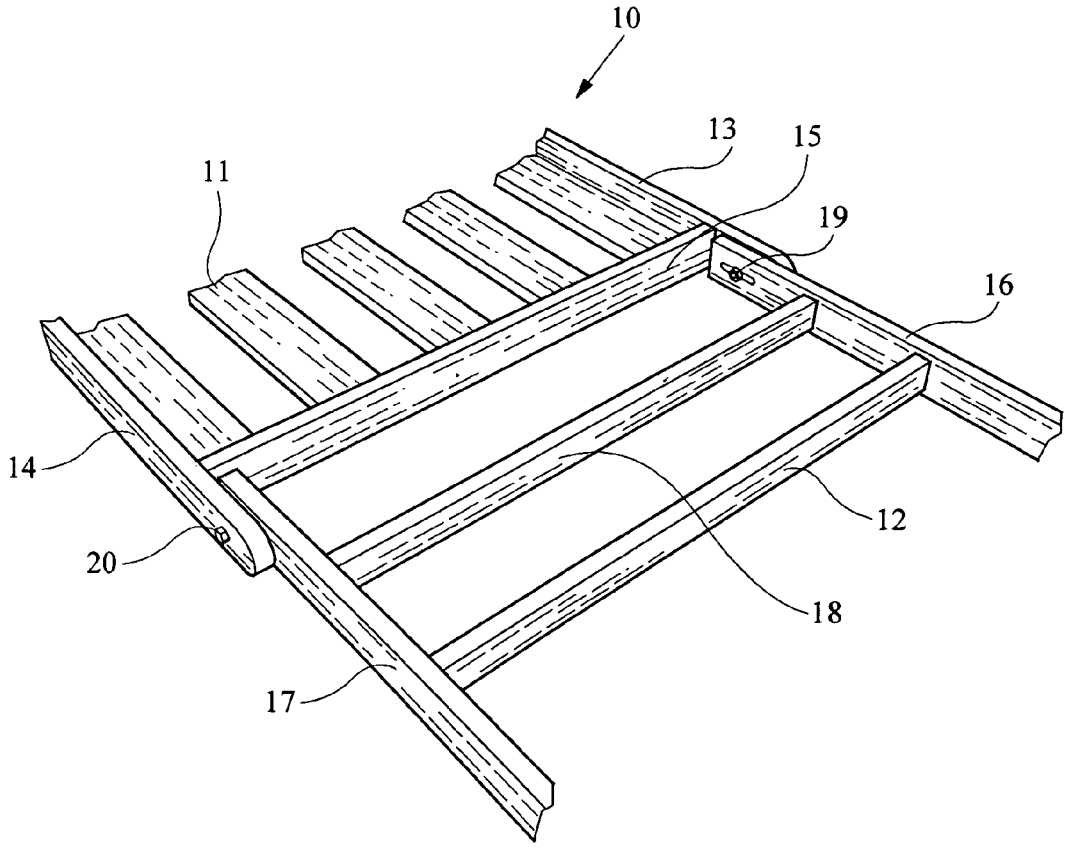
FIG. 1 (Prior Art)
FIG. 1 is a partial perspective view of a prior art furniture frame.

Referring to FIG. 1, FIG. 1 is a partial perspective view showing a prior art furniture frame 10 that is convertible between a bed position and a couch position. Furniture frame 10 comprises a backrest section 11 and a seat section 12. As shown in FIG. 1, the backrest section 11 includes a first side 13, a second side 14 and a cross member 15 linking the first side 13 of the backrest section 11 to the second side 14 of the backrest section 11. The seat section 12 includes a first side 16, a second side 17 and a cross member 18 linking the first side 16 of the seat section 12 to the second side 17 of the seat section 12.

Located on the sides of the backrest section 11 and the seat section 12 is a first pin 19 linking the first side 13 of the backrest section 11 to the first side 16 of the seat section 12 and a second pin 21 linking the second side 14 of the backrest section 11 to the second side 17 of the seat section 12. Although not clearly shown, in order to maintain the linkage between the backrest section 11 and the seat section 12, a nut is secured to a free end of the first pin 19 and a free end of the second pin 20 to prevent withdrawal of the pins 19 and 20.

Figure 2:
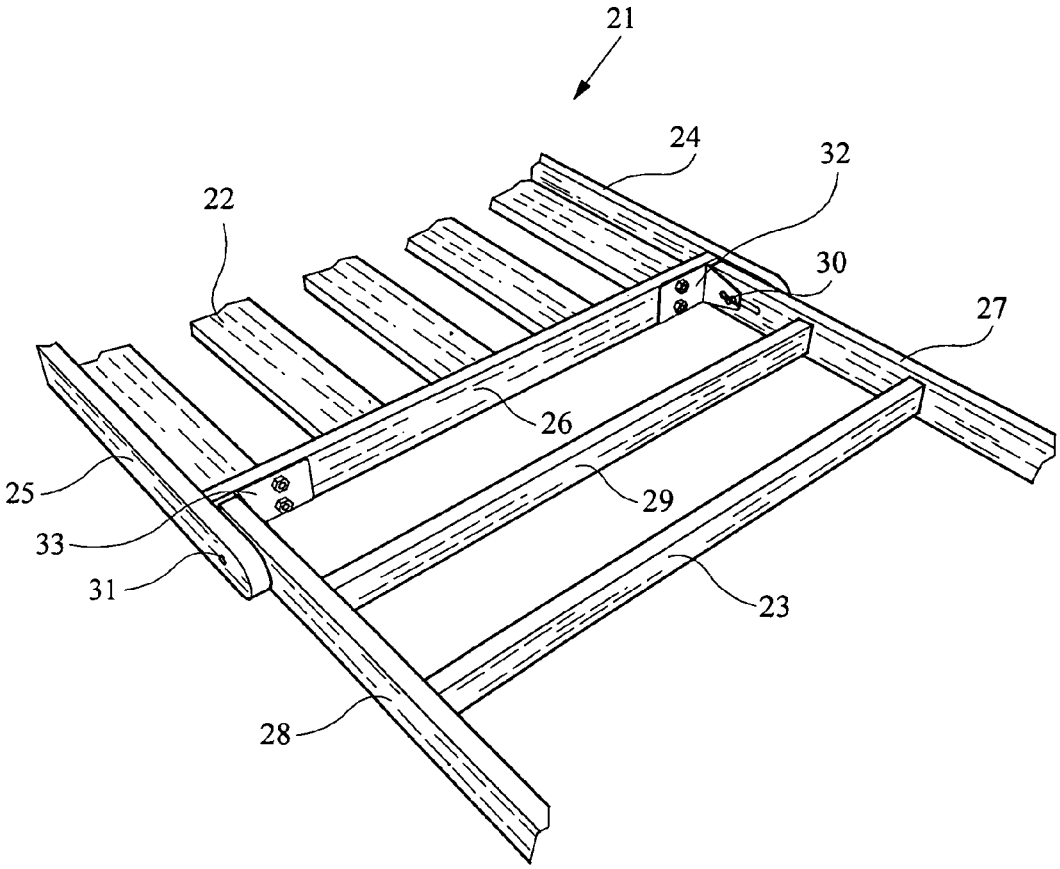
FIG. 2 is a partial perspective view of a furniture frame of the present invention.

Referring to FIG. 2, FIG. 2 is a partial perspective view showing a furniture frame 21 of the present invention. Furniture frame 21 is similar to the furniture frame 10 of FIG. 1 as furniture frame 21 also comprises a backrest section 22 having a first side 24, a second side 25 and a cross member 26 linking the first side 24 of the backrest section 22 to the second side 25 of the backrest section 22 and a seat section 23 having a first side 27, a second side 28 and a cross member 29 linking the first side 27 of the seat section 23 to the second side 28 of the seat section 23. Located on the sides of the backrest section 22 and the seat section 23 is a first pin 30 linking the first side 24 of the backrest section 22 to the first side 27 of the seat section 23 and a second pin 31 linking the second side 25 of the backrest section 22 to the second side 28 of the seat section 23.

However, unlike the furniture frame of FIG. 1, Furniture frame 21 further includes a first furniture frame bracket 32 for further supporting the linkage between the first sides 24 and 27 of the backrest section 22 and the seat section 23 and a second furniture frame bracket 33 for supporting the linkage between the second sides 25 and 28 of the backrest section 22 and the seat section 23 by further distributing the forces that are directed on the linkages between the backrest section 22 and the seat section 23 of the furniture frame 21 so as to reduce the potential for breakage of the aforementioned linkage. Although furniture frame brackets 32 and 33 are shown secured to the cross panel member 26 of the backrest section 22, furniture frame brackets 32 and 33 can alternatively be secured to the cross panel member 29 of the seat section 23.

Figure 3:
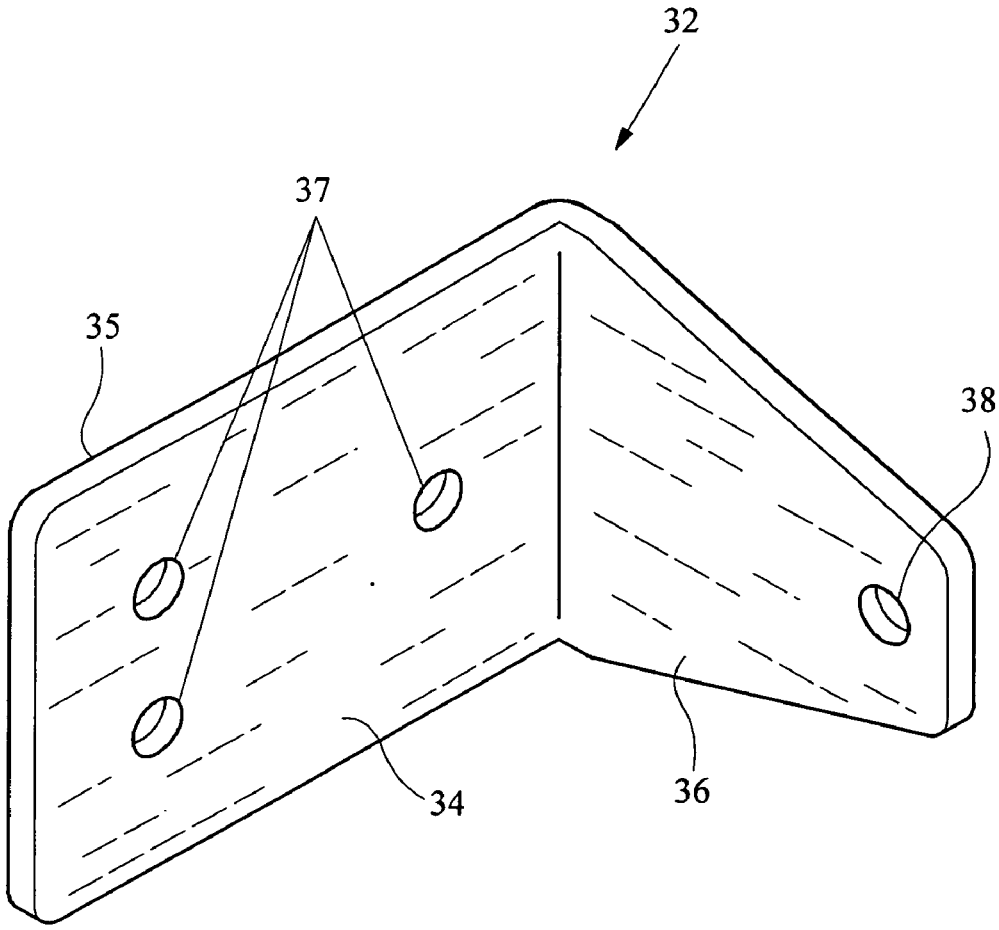
FIG. 3 shows a close-up view of a furniture frame bracket of the present invention.

FIG. 3 shows a close-up view of the first furniture frame bracket 32 of furniture frame 21. Although first furniture frame bracket 32 will be further described, it is noted that the second furniture frame bracket 33 will have similar corresponding parts that are described for first furniture frame bracket 32. As shown in FIG. 3, furniture frame bracket 32 comprises a bracket main body 34 having an outer surface 35 for engaging a portion of the furniture frame and a leg 36 for supporting the linkage between the first side 24 of the backrest section 22 and the first side 27 of the seat section 23.

Although furniture frame bracket 32 can be secured to the furniture frame in various ways such as by the use of an adhesive, FIG. 3 shows bracket main body 34 of first furniture frame bracket 32 having multiple attachment member guides 37 located thereon for guiding attachment members such as nails or a bolts therethrough for the securement of furniture frame bracket 32 to the surface of the furniture frame.

In regards to the leg 36 of furniture frame bracket 32, although leg 36 can be position at various angles with respect to the main body 34 of furniture frame bracket 32, leg 36 is preferably position perpendicular to the bracket main body 34 of furniture frame bracket 32. Referring to FIG. 3, note that furniture frame bracket 32 also includes an orifice 38 located on the leg 36 of the bracket 32 for the extension of a protruding member therethrough.

Figure 4:
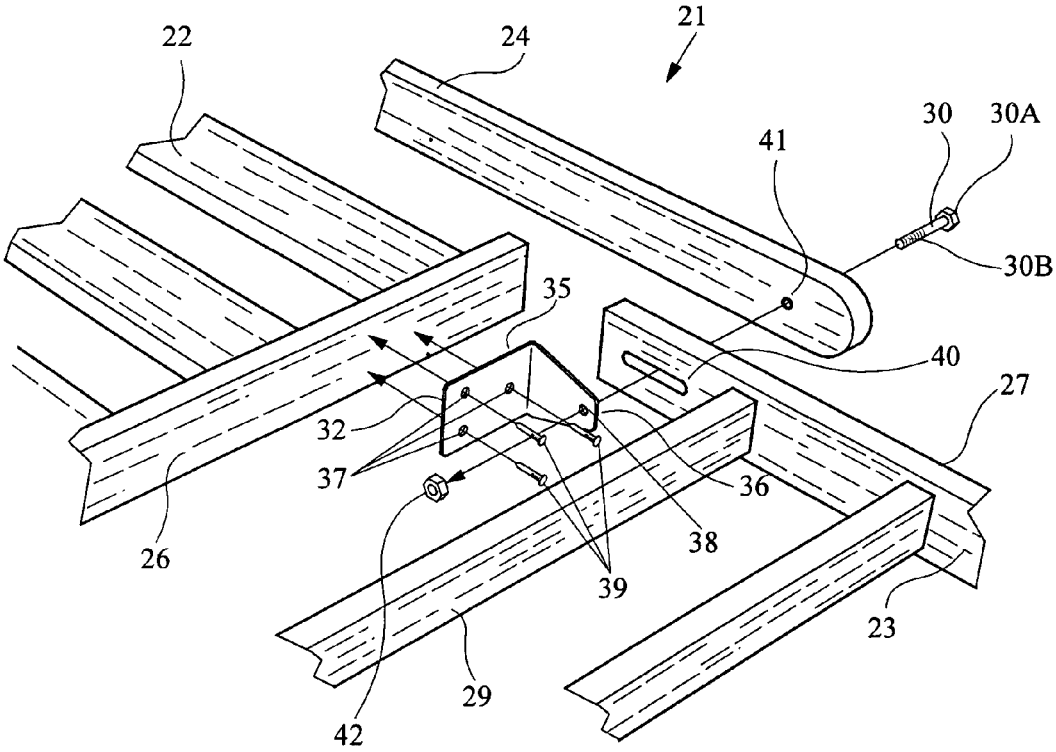
FIG. 4 is a partial exploded view showing the assembly of first furniture frame bracket to the furniture frame.

FIG. 4 is a partial exploded view showing the assembly of furniture frame bracket 32 to furniture frame 21. Referring to FIGS. 2 and 4, in the assembly of furniture frame bracket 32 to furniture frame 21, the outer surface 35 of bracket 32 first engages a portion of the cross panel member 26. Furniture frame bracket 32 is then fixed to the cross panel member 26 of furniture frame 21 by the use of an attachment member comprising a plurality of screws 39, which as shown in FIG. 4, are directed through furniture frame bracket 32 by a plurality of attachment member guides 37.

It is noted that although a plurality of screws are used in the embodiment of FIG. 4 for the securement of furniture frame bracket 32 to furniture frame 21, as few as one screw can be used to secure first furniture frame bracket 32 to furniture frame 21. It is further noted that attachment members including but not limited to nail(s), nut(s) & bolt(s), or an adhesive can also be used to secured furniture frame bracket 32 to furniture frame 21.

Once furniture frame bracket 32 is secured to cross panel member 26, a portion of the first side 27 of the seat section 23 having a slot 40 located therein is sandwichly positioned between the first side 24 of backrest section 22 and the leg 36 of furniture frame bracket 32. The first side 24 of the backrest section 22 is then connected to the first side 27 of the seat section 23 and further supported by the leg 36 of furniture frame bracket 32 by the use of a first protruding member comprising a pin 30 having a head 30A and a free end 30B.

As shown in FIG. 4, although it is preferred that the first side 24 of the backrest section 22, the first side 27 of the seat section 23, and the orifice 38 of bracket 32 are linked by the extension of the free end 30B of pin 30 first through an access guide 41 located on the first side 24 of the backrest section 22, then through the slot 40 of the first side 27 of the seat section 23, and finally, through the orifice 38 of leg 36, it is noted that the free end 30B of pin 30 alternatively can extend first through the orifice 38 bracket 32, then through the slot 40 of the first side 27 of the seat section 23, and finally through access guide 41 of first side 24 of backrest portion 22.

In further regards to the above, in order to maintain the linkage between the backrest section 22 and the seat section 23 of the furniture frame 21, a locking member such as nut 42 can be secured to the free end 30B of the pin 30 to prevent the withdrawal of pin 30.

Figure 5:
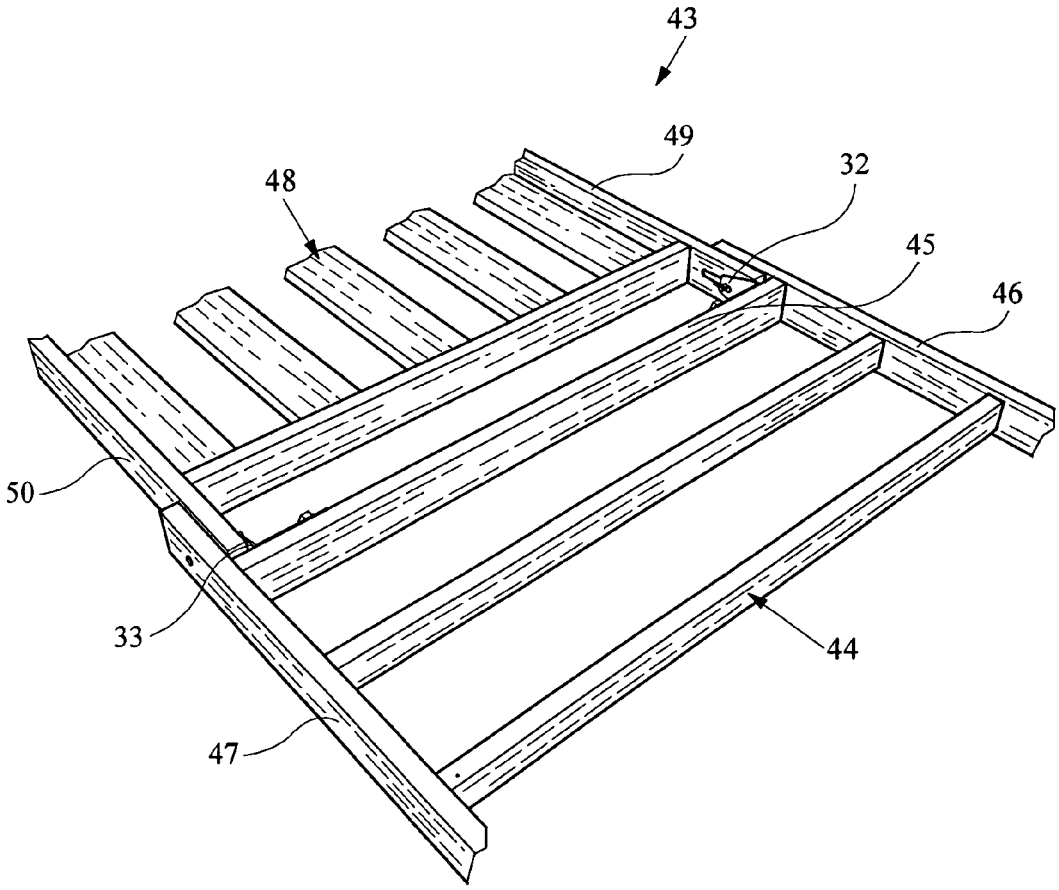
FIG. 5 is a partial perspective view showing an alternative embodiment of a furniture frame of the present invention.

Referring to FIG. 5, FIG. 5 is a partial perspective view showing a furniture frame 43 of the present invention similar to the furniture frame 21 of FIG. 2. However, unlike the furniture frame of FIG. 2, Furniture frame 43 shows first furniture frame bracket 32 and second furniture frame bracket 33 secured to a cross panel member 45 of a seat section 44 of the furniture frame 43 for further supporting the linkage between the first sides 46 and 49 of a backrest section 48 and the seat section 44 and the linkage between the second sides 47 and 50 of the backrest section 48 and the seat section 44 by further distributing the forces that are directed on the linkages between the backrest section 48 and the seat section 44 of the furniture frame 43 so as to reduce the potential for breakage of the aforementioned linkage.

I claim:

1. A furniture frame comprising:

a first section having a first side and a second side;

a second section having a first side and a second side;

a first furniture frame bracket comprising a bracket main body resting against said first section proximal said first side of said first section and a leg resting against said second section and supporting a linkage between said first sides of said first section and said second section; and a second furniture frame bracket comprising a bracket main body resting against said first section proximal said second side of said first section and a leg resting against said second section and supporting a linkage between said second sides of said first section and said second section.

2. The furniture frame of claim 1 wherein said leg of said first furniture frame bracket includes a surface for cooperating with said first side of said first section to sandwich said first side of said second section therebetween.

3. The furniture frame of claim 1 including a cross panel member located on said first section for linking said first side of said first section to said second side of said first section wherein said outer surfaces of said first furniture frame bracket and said second furniture frame bracket are engageably secured to said first section cross panel member.

4. The furniture frame of claim 1 including a cross panel member located on said second section for linking said first side of said second section to said second side of said second section wherein said outer surfaces of said first furniture frame bracket and said second furniture frame bracket are engageably secured to said second section cross panel member.

5. The furniture frame of claim 1 wherein said leg of said first furniture frame bracket is located perpendicular to said bracket main body of said first furniture frame bracket and said leg of said second furniture frame bracket is located perpendicular to said bracket main body of said second furniture frame bracket.

6. The furniture frame of claim 1 wherein said first section comprises a backrest section and said second section comprises a seat section.

7. The furniture frame of claim 1 wherein said first side of said first section is connected to said first side of said second section by a first protruding member and said second side of said first section is connected to said second side of said second section through an extension of a second protruding member.

8. The furniture frame of claim 7 wherein said first side of said first section is connected to said first side of said second section by a first protruding member through said first side of said first section, an elongated slot located on the first side of the second section and an orifice located on said first furniture frame bracket, and said second side of said first section is connected to said second side of said second section through the extension of a second protruding member through said second side of said first section, an elongated slot located on said second side of said second section and an orifice located on said second furniture frame bracket.

9. The furniture frame of claim 7 wherein said first protruding member comprises a first pin and said second protruding member comprises a second pin.

10. The furniture frame of claim 9 including a guide located on said first side of said first section and a guide located on said second side of said first section for guiding said pins therethrough.

* * * * *